United States Patent [19]

Mosher

[11] 4,232,457

[45] Nov. 11, 1980

[54] ORTHOTIC INSERT

[76] Inventor: Mitchell R. Mosher, 120 Ascot Dr. #D, Roseville, Calif. 95678

[21] Appl. No.: 8,025

[22] Filed: Jan. 31, 1979

[51] Int. Cl.[2] ..... A43B 13/40; A43B 7/22

[52] U.S. Cl. ..... 36/44; 36/91; 128/595; 128/607; 128/614

[58] Field of Search ..... 36/44, 43, 91, 71; 128/586, 595, 607, 614

[56] References Cited

U.S. PATENT DOCUMENTS

| | | | |
|---|---|---|---|
| 1,976,441 | 10/1934 | Feldman | 128/614 |
| 2,500,591 | 3/1950 | Watkins et al. | 128/614 |
| 3,835,558 | 9/1974 | Revill | 36/44 |

FOREIGN PATENT DOCUMENTS

| | | | |
|---|---|---|---|
| 520761 | 7/1953 | Belgium | 128/595 |
| 1005399 | 12/1951 | France | 128/607 |
| 585532 | 3/1977 | Switzerland | 36/91 |
| 583683 | 12/1946 | United Kingdom | 128/595 |

OTHER PUBLICATIONS

*Runner's World,* vol. 13, No. 10, Oct. 1978, p. 148.

*Primary Examiner*—James Kee Chi
*Attorney, Agent, or Firm*—Townsend and Townsend

[57] ABSTRACT

An orthotic insert formed of a resilient molded flexible plastic support member, a thin layer of vinyl applied to the upper surface, and a spongy resilient heel post mounted on the lower surface in the heel region. The insert extends from beneath the heel to a location proximal of the heel of the metatarsal joints of a user's foot. The insert is flexible enough to accommodate variations in individual feet without the need for custom fitting, yet resists flex sufficiently to beneficially limit excessive foot pronation and thereby minimize injuries associated therewith.

4 Claims, 5 Drawing Figures

ORTHOTIC INSERT

FIELD OF THE INVENTION

The invention relates to improvements in orthotic inserts, intended for runners, skiers and the like.

BACKGROUND OF THE INVENTION

The prior art includes conventional foam rubber arch supports which may be purchased in drugstores or the like. These provide relatively little effective arch support, but have the advantage of being adaptable to nearly any foot within a given size range. Thus, they can be produced and sold inexpensively, and are readily available to the public at large.

The prior art also includes custom fitted orthotic inserts formed of incompressible materials. These are very rigid, and provide a high degree of effective arch support, but because of their rigidity, must be custom fitted to the user's foot. These devices, while very effective, are quite expensive.

A proper arch support ("orthosis") prevents excessive pronation of the foot at both heel strike and midstance, and at points between. Excessive pronation can occur in a weak foot during normal walking or standing; however, even a relatively strong foot will undergo excess pronation during vigorous exercise and particularly in sports like running and skiing where the legs and feet are called upon to absorb a substantial amount of shock.

Excessive pronation causes the tibia and fibula to rotate inwardly, placing strain on the leg muscles, on the medial (inner) side of the knee, and in the plantar fascia. Over time, these strains lead to injury.

Because of the cost and time involved, or for lack of information, many persons who could benefit from effective orthosis, as a preventative, neglect to seek it until after an injury has occurred. Thus, it is desirable, as a preventative measure, to make effective orthosis available conveniently and inexpensively.

SUMMARY OF THE INVENTION

I have discovered that effective orthosis can be provided, conveniently and inexpensively, without the need for custom fitting, by means of the orthotic insert of the present invention.

Through the use of a solid but flexible, resilient support, my device provides excellent orthosis, yet yields sufficiently to adapt to a great variety of feet of a given size, or within a given range of sizes. The key feature of my orthotic lies in the combination of a compressible, resilient heel post with a firm, but flexible plastic support member of uncompressible material. In combination, these yield to different foot types, but impose substantial limitations on the amount of pronation which is allowed. This depends upon the physical characteristics of the materials chosen for both the plastic support member and the heelpost, as well as their particular configurations and mutual assemblage.

The plastic support member is formed preferably of 3/32" polypropylene sheet, cut to shape, and molded to a particular configuration. The configuration is defined in terms of the elevation or rise at three points: the flange of the medial longitudinal arch, the lateral longitudinal arch, and the metatarsal arch. The configuration is further defined in terms of the varus (outward tilting) of the heel. In static condition, the rise at both the flange of the medial longitudinal arch and the lateral longitudinal arch, as well as the varus, are dependent upon the size, shape and location of the heel post. The heel post is mounted beneath the heel, is preferably formed of a medium density sponge rubber, and is about 3/16" thick at its thinnest point in the center of the heel.

Having once defined the configuration of the device in static terms, the kinetic characteristics follow, since a device constructed in this manner from these particular materials will have relatively predictable kinetic characteristics. This is not to say that the device will perform identically for each user, but that when subjected to certain kinetic conditions, devices so constructed will perform relatively predictably. Specifically, the support member will flex under downward pressure at each of the three arches mentioned above. The degree of flex will vary from user to user, depending on the user's weight and foot shape, and on the particular activity in which he is engaged. To say that the device will prevent excess pronation on every footfall of every user in every situation would be misleading; however, for a great variety of users in a great variety of situations, pronation will be significantly limited and the orthotic will be found comfortable to wear.

In summary, the invention depends upon the particular static configuration and the materials selected, so as to afford a controlled degree of flex in the kinetic state. It is control which is important. If the device does not flex enough, many users will experience discomfort; whereas if the device flexes too much, it will not provide effective orthosis.

In its narrowest sense, my invention depends upon the particular configurations and materials chosen. In a broader sense, my invention is not limited by the materials chosen, since a comparable degree of controlled flex might be afforded with substitute materials.

I refer to the plastic support member as formed of a flexible, but "incompressible" material. This is to distinguish from those materials such as foam rubber which compress readily under relatively small pressure. Admittedly, when the support member flexes, there is a degree of internal compression and matching tension; and, also, almost any material can be compressed when subjected to sufficient pressure. By use of the term "incompressible", I am not intending to exclude these conditions. The term does not exclude internal compression during flex; nor does it contemplate that the material might compress under pressures far in excess of those it is normally subjected in use in the device of my invention.

DESCRIPTION OF THE PREFERRED EMBODIMENT

Figure 1:
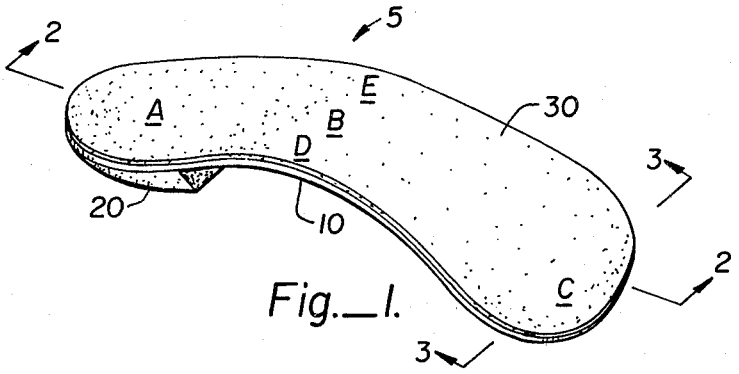
FIG. 1 is a perspective view of an orthotic insert according to the present invention.

FIG. 1 shows an orthotic insert 5 according to the present invention consisting of three main elements as follows: a flexible, resilient plastic support member 10; a yieldable resilient heel post 20; and a vinyl upper layer 30. The orthotic insert can be spoken of as divided roughly into the following three regions, as shown in FIG. 1: the heel region A, the arch region B, and the metatarsal region C. The arch region B includes the medial longitudinal arch flange D, and the lateral longitudinal arch region E.

Figure 5:
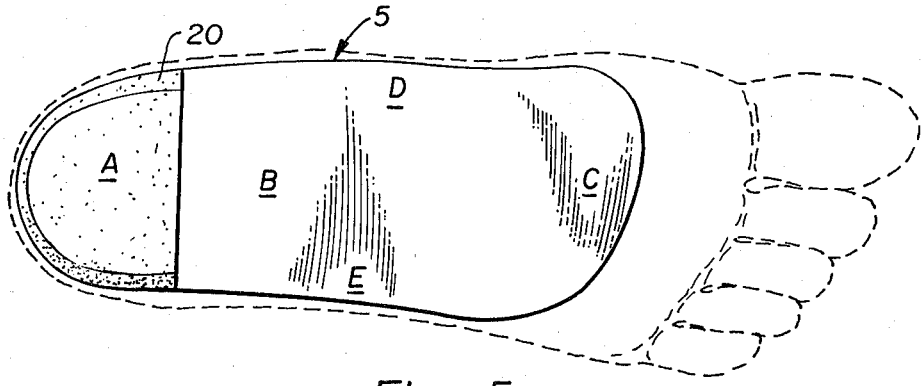
FIG. 5 is a bottom view showing the intended relation of the orthotic insert of the present invention to a human foot.

As shown in FIG. 5, the orthotic insert 5 is intended to be worn with the heel region A locating beneath the user's heel, the arch region B locating beneath the user's arch and the metatarsal region C locating proximally of the heads of the user's metatarsal joints. In common terms, the device stops just short of the ball of the foot.

The support member 10 is formed of 3/32" thick polypropylene sheet, which is a material having substantially uniform thickness.

Figure 3:
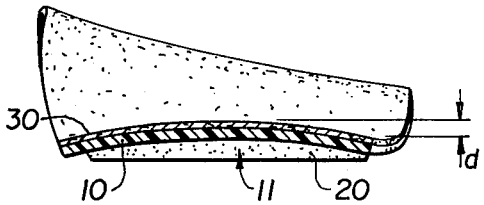
FIG. 3 is a cross sectional frontal elevation taken along the lines 3—3 of FIG. 1.

First, the support member 10 is cut from the sheet to have an outline generally conforming to the outline of a foot in those regions proximal from the metatarsal joints. Then, the support member 10 is molded under heat and pressure into a particular configuration characterized by an upward rise of approximately ⅛" at the metatarsal arch, as shown in FIG. 3. The place at which the rise occurs is indicated by the numeral 11 and the extent of rise indicated by the letter d. As shown, when measuring the rise of the metatarsal arch, one measures the extent of rise in the upper surface from the lateral or medial edge to the center of the insert 5.

Figure 4:
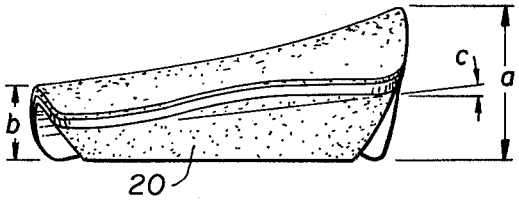
FIG. 4 is a rear elevation taken along the lines 4—4 of FIG. 2.

The configuration of the support member, in combination with the heel post 20, is further characterized by a rise of approximately 1" at the flange D of the medial longitudinal arch, as indicated by the letter a; and a rise of approximately 7/16" in the lateral longitudinal arch region E, as indicated by the letter b. As shown in FIG. 4, when measuring the rise in the medial longitudinal arch and the lateral longitudinal arch, the measurement is taken from the floor to the upper surface of the orthotic insert 5.

The configuration of the support member, again in combination with the heel post 20, is further characterized by a 4° to 5° varus in the heel region A, as indicated by the letter c in FIG. 4. As a result of the varus, the medial or inside edge of the heel tilts up.

The heel post 20 is constructed of a medium density natural sponge rubber. Suitable material is available from Faultless Rubber Company, Ashland, Ohio, product No. 71-6000. This material is an open cell natural sponge rubber, chemically blown, with an ASTM grade rating R-13ABDP, having a compression/deflection rating of 7 to 14 pounds per square inch. It is available in sheets having a thickness of ½ inch and can be cut and trimmed to the desired shape.

The heel post 20 is glued to the lower surface of the support member 10 in the heel region A. To provide adequate cushioning and elevation, it should be at least about 3/16" of an inch thick at its thinnest point. As shown in FIG. 4, the heel post 20 is higher (thicker) at the medial (inner) edge of the heel than it is at the lateral edge of the heel. This cooperates with the molded plastic support 10 to provide the desired 4°–5° varus in heel region.

The plastic support member 10 may be covered on its upper surface with a thin sheet of vinyl cut to conform to the shape of the plastic support 10. The vinyl 30 can be glued to the upper surface of the support member 10. Leather or other similar materials may be substituted for vinyl in construction of the upper layer 30, or it may be dispensed with entirely, as desired.

When worn, the orthotic insert 5 of the present invention is designed to flex. In the interim between heel strike and mid stance, the arch region B yields downwardly under pressure of the foot, but does not normally collapse completely. This controlled flexing action allows the insert 5 to accommodate to the shape of the wearer's foot, yet limits the amount of pronation which the foot will undergo. In this manner, the wearer receives the primary benefit of a custom fitted orthotic without the need to have it custom fitted.

Figure 2:
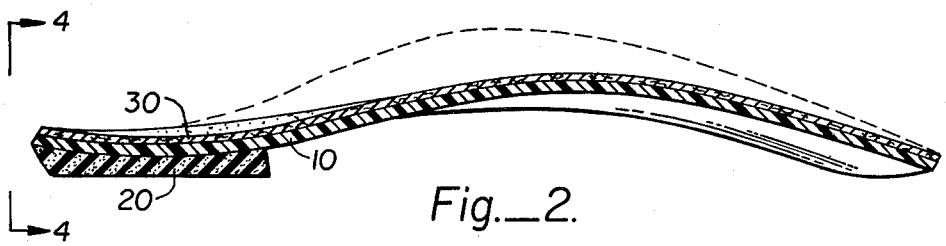
FIG. 2 is a cross sectional side elevation taken along the lines 2—2 of FIG. 1, with the cutaway portion shown in phantom.

FIGS. 2–4 of the drawings are drawn to scale, 1"=1"; except that the varus is slightly exaggerated for purpose of illustration.

I claim:

1. An orthotic insert comprised of a plastic support member adapted to extend beneath the heel and arch of a user's foot, terminating at points proximal to the user's metatarsal heads; and, a heel post mounted on the lower surface of said support member at the heel region; wherein said support member is formed of incompressible, flexible, resilient plastic sheet; said heel post is formed of a compressible, resilient material; said plastic sheet is molded to provide a rise of about 1/8" in the matatarsal arch and, when assembled with said heel post, to provide a rise of about 1" at the flange of the medial longitudinal arch, a rise of about 7/16" at the lateral longitudinal arch, and a 4°–5° varus at the heel; and said heel post is approximately 3/16" at its thinnest point.

2. The orthotic insert of claim 1, wherein said support member is formed of 3/32" polypropylene.

3. The orthotic insert of claim 2, wherein said heel post is formed of sponge rubber having a compression/deflection rating of 7–14 pounds per square inch.

4. An orthotic insert comprised of:

a flexible, resilient, incompressible plastic support member adapted to extend beneath the heel and arch of a human foot terminating at a location proximal of the metatarsal heads; and, a yieldable, resilient sponge-like heel post mounted on the lower surface of said support member at the heel; wherein said support member is formed of plastic sheet of substantially uniform thickness, said sheet being molded to provide rises at the medial longitudinal arch, at the lateral longitudinal arch, and at the matatarsal arch, and further to provide a varus at the heel; wherein said support member is sufficiently flexible to flex, when worn in use, at one or more of said rises to conform to a variety of users, yet being sufficiently inflexible to limit pronation of the user's foot in use.

* * * * *